US005771523A

United States Patent [19]

Rudolph

[11] Patent Number: 5,771,523

[45] Date of Patent: Jun. 30, 1998

[54] GOLF TOWEL WITH CONNECTOR MEMBER

[75] Inventor: James M. Rudolph, Orange County, Calif.

[73] Assignee: Rudolph Sports, Brea, Calif.

[21] Appl. No.: 688,422

[22] Filed: Jul. 30, 1996

[51] Int. Cl.[6] ..... A47L 13/16

[52] U.S. Cl. ..... 15/209.1; 2/279; D6/608

[58] Field of Search ..... 15/209.1, 208, 15/210.1, 214, 235; D6/608, 609, 546, 547; 2/279

[56] References Cited

U.S. PATENT DOCUMENTS

| | | | |
|---|---|---|---|
| D. 385,742 | 11/1997 | Bird | D6/608 |
| 585,526 | 6/1897 | Kennedy | 15/208 |
| 968,924 | 8/1910 | Enge | 15/209.1 |
| 2,221,305 | 11/1940 | Chase | 15/209.1 |
| 2,305,340 | 12/1942 | Ellestad | 15/209.1 |
| 2,754,532 | 7/1956 | Konehl et al. | 15/209.1 |
| 3,184,759 | 5/1965 | Masters | 2/279 |
| 4,516,616 | 5/1985 | Fesler | 15/209.1 |
| 5,147,703 | 9/1992 | Provost et al. | 15/209.1 |

*Primary Examiner*—Gary K. Graham
*Attorney, Agent, or Firm*—John J. Connors; Connors & Assoc.

[57] ABSTRACT

A golf towel is attached and detached to a golf bag with a male connector on the bag. The golf towel has a towel body with a snap therein near a corner of the towel. The snap has a cap and a female connector which is adapted to be coupled to the male connector on the golf bag. There is a reinforcing member formed into a loop which facilitates removal of the towel from the golf bag. The towel body and the ends of the reinforcing member are disposed between the cap and female connector, which are fitted together to hold the towel body and these ends securely between the cap and female connector.

3 Claims, 1 Drawing Sheet

FIG. 1
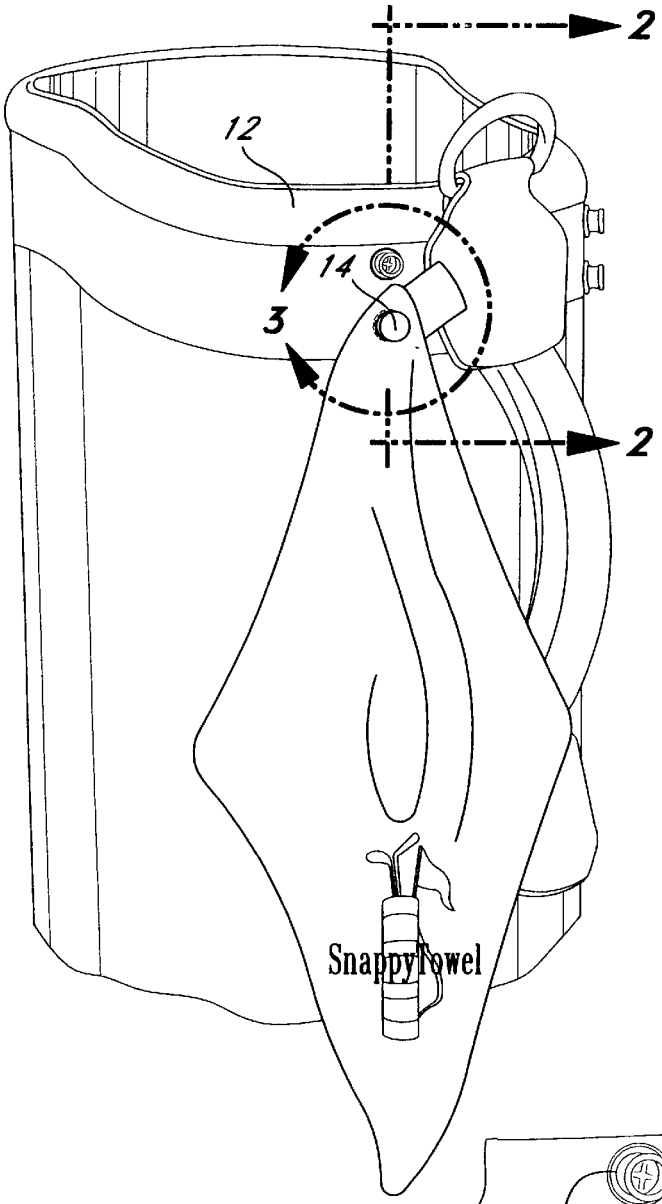
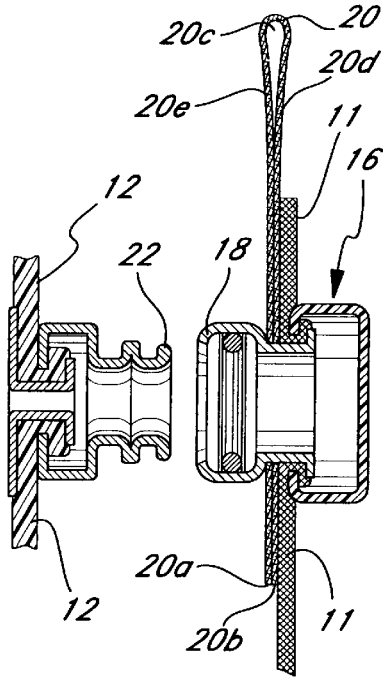
FIG. 2
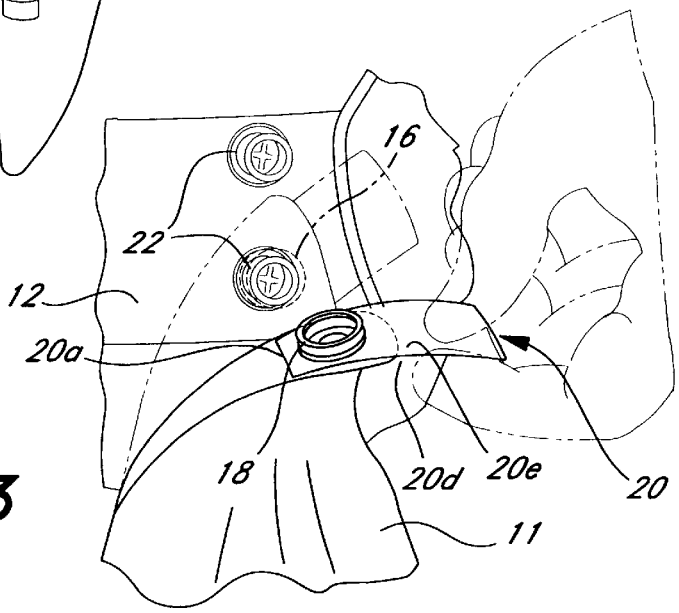
FIG. 3

GOLF TOWEL WITH CONNECTOR MEMBER

BACKGROUND OF THE INVENTION

1. Field of the Invention

This invention relates to towels, especially a towel used by golfers.

2. Background Discussion

Frequently, golfers carry with them a towel to wipe off their hands and golf clubs. The golfers tuck the ends of the towels under their belts, in their pockets, and it has even been suggested to employ a snap that can be snapped onto complementary connectors commonly employed on golf bags.

SUMMARY OF THE INVENTION

It is the objective of this invention to provide a golf towel with a snap that is reinforced and is easy to unsnap from its complementary connector.

This invention has several features, no single one of which is solely responsible for its desirable attributes. Without limiting the scope of this invention as expressed by the claims which follow, its more prominent features will now be discussed briefly. After considering this discussion, and particularly after reading the section entitled, "DETAILED DESCRIPTION OF THE PREFERRED EMBODIMENT," one will understand how the features of this invention provide its benefits, which include its durability and ease of use.

The first feature of the golf towel of this invention is that it includes a towel body having a snap therein near a corner of the towel. The snap has a cap and a female connector. The towel has a generally rectangular shape where the snap is at least within four inches from one corner of the towel.

The second feature is a reinforcing member comprising a piece of elongated material having opposed ends. This piece of elongated material is formed into a loop with the opposed ends positioned near each other. This reinforcing member is made of a material that resists tearing and it provides reinforcement for the snap so that the snap does not easily tear away from the body of the towel.

The third feature is that the towel body and the ends of the material are disposed between the cap and female connector, which are fitted together to hold the towel body and the ends securely between the cap and female connector. The female connector is adapted to connect to a male connector carried on a golf bag, and the looped reinforcing member facilitates removal of the towel when it is attached to the golf bag.

This invention also includes a method of of attaching and detaching a golf towel to a golf bag with a male connector on the bag. This method includes the following steps:

(a) providing a golf towel having a towel body having a snap therein near a corner of the towel, said snap having a cap and a female connector which is coupled to the male connector on the golf bag, and a reinforcing member comprising a piece of elongated material having opposed ends, said piece of elongated material being formed into a loop with the opposed ends being positioned near each other, said towel body and said ends of the material being disposed between the cap and female connector, which are fitted together to hold the towel body and said ends securely between the cap and female connector, and (b) detaching the golf towel from the golf bag by manually grasping the reinforcing member to pull the female connector from the male connector.

DESCRIPTION OF THE DRAWING

The preferred embodiment of this invention, illustrating all its features, will now be discussed in detail. This embodiment depicts the novel and non-obvious credit card and method of this invention as shown in the accompanying drawing, which is for illustrative purposes only. This drawing includes the following figures (Figs.), with like numerals indicating like parts:

FIG. 1 is a side view of a golf bag having attached to it a golf towel of the present invention.

FIG. 2 is a cross-sectional view taken along line 2—2 of FIG. 1.

FIG. 3 is an enlarged exploded perspective view of the snap attached to a corner of the golf towel.

DETAILED DESCRIPTION OF THE PREFERRED EMBODIMENT

As best shown in FIG. 1, the golf towel 10 of this invention is adapted to be attached and detached to a golf bag 12 by means of a conventional snap 14 such as commonly used on golf bags. Such conventional snaps 14 include a cap 16 which is secured to a female connector 18. The cap 16 and female connector 18 have sufficient spacing between them to allow the body 11 of the towel 10 and a looped reinforcing material 20 to be inserted between the cap and female connector prior to being fitted together.

The towel body 11 is generally rectangular having four corners with the snap 14 being near one of the corners 11*a*. Preferably, the snap 14 should be no more than about 4 inches from the corner 11*a*. Typically, the snap 14 is placed at a position in the towel body 11 which is from 1 to 4 inches from the corner 11*a*. The towel 10 may be square, a special case of a rectangular, but preferably has a length of from about 10 to about 24 inches and a width of from about 10 to about 18 inches. Cotton is the preferred material for the towel 10.

The looped reinforcing material 20 preferably also is rectangular with an unfolded length of from about 3.5 to about 6 inches, and a width of from about 1 to about 1.5 inches. It is preferably made of a strong fabric such as, for example, tightly woven nylon, which resists tearing.

The towel body 11 and the folded reinforcing material 20 are positioned between the cap 16 and female connector 18 prior to riveting the cap and female connected together. The reinforcing material 20 is folded so that its ends 20*a* and 20*b* abut to form a loop space 20*c* between to two sides 20*d* and 20*e* of the looped reinforcing material 20. When properly aligned, the cap 16 is pressed into the female connector 18 with the towel body 11 and ends 20*a* and 20*b* of the reinforcing material 20 wedged between the cap and female connector.

To use the towel 10 of this invention, the snap 14 is first aligned with a male connector 22 (FIGS. 2 and 3) on the golf bag 12 and then the female connector 18 is pushed against the male connector to force the male connector into the female connector. The towel 10 is now held securely to the golf bag 12 and may be conveniently used without removal. However, if the golfer desires to detach the towel 10 from the golf bag 12, he or she simply places their index finger into the loop space 20*c*, and then pulls in a direction away from the bag to pull the female connector 18 free from the male connector 22.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiment disclosed. On the contrary, the intention is to cover all modifications and alternate constructions coming within the spirit and scope of the invention as generally expressed by the following claims, which particularly point out and distinctly claim the subject matter of the invention:

I claim:

1. A golf towel including a towel body having a snap therein near a corner of the towel, said snap having a cap and a female connector, and a reinforcing member comprising a piece of elongated material having opposed ends, said piece of elongated material being formed into a loop with the opposed ends being positioned near each other, said towel body and said ends of the material being disposed between the cap and female connector, which are fitted together to hold the towel body and said ends securely between the cap and female connector.

2. The golf towel of claim 1 having a generally rectangular shape where the snap is at least within four inches from one corner of the towel.

3. The golf towel of claim 1 where the female connector is adapted to connect to a male connector carried on a golf bag.

* * * * *